US006609383B1

(12) United States Patent
Kusada et al.

(10) Patent No.: US 6,609,383 B1
(45) Date of Patent: Aug. 26, 2003

(54) CRYOGENIC REFRIGERATION SYSTEM

(75) Inventors: Shigehisa Kusada, Aichi (JP); Tomoyuki Motoyoshi, Aichi (JP); Yoshinao Sanada, Kanagawa (JP); Keiji Tomioka, Osaka (JP)

(73) Assignees: Central Japan Railway Company, Nagoya (JP); Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/290,255

(22) Filed: Nov. 8, 2002

(30) Foreign Application Priority Data

May 20, 2002 (JP) ..... 2002-144654

(51) Int. Cl.[7] ..... F25B 19/02
(52) U.S. Cl. ..... 62/51.2
(58) Field of Search ..... 62/6, 45.1, 50.1, 62/51.2, 333

(56) References Cited

U.S. PATENT DOCUMENTS 5,966,944 A * 10/1999 Inoue et al. ..... 62/51.1
6,347,522 B1 * 2/2002 Maguire et al. ..... 62/6
6,354,087 B1 * 3/2002 Nakahara et al. ..... 62/6

FOREIGN PATENT DOCUMENTS

JP 9-229503 A 9/1997

* cited by examiner

*Primary Examiner*—Denise L. Esquivel
*Assistant Examiner*—Malik N. Drake
(74) *Attorney, Agent, or Firm*—Nixon Peabody LLP; Donald R. Studebaker

(57) ABSTRACT

The cryogenic refrigeration system of the present invention includes: a shield plate for preventing a radiant heat from entering a superconducting magnet; a helium refrigerator for generating a liquid helium, the helium refrigerator including a pre-cooling refrigerator for pre-cooling a helium gas; and a nitrogen refrigerator for cooling nitrogen in a nitrogen tank; and a controller, whereby when a vehicle is running, a low pressure side compressor and a high pressure side compressor are operated, and the helium refrigerator and the nitrogen refrigerator are operated, whereas when the vehicle is not running, the operation of the pre-cooling refrigerator of the helium refrigerator is stopped while the operation of the nitrogen refrigerator is continued.

6 Claims, 4 Drawing Sheets

CRYOGENIC REFRIGERATION SYSTEM

FIELD OF THE INVENTION

The present invention relates to a cryogenic refrigeration system for cooling a superconducting magnet.

BACKGROUND OF THE INVENTION

A cryogenic refrigeration system capable of generating a cryogenic temperature of a 4 K level is used as a system for cooling a superconducting magnet. For a cryogenic refrigeration system of this type, it is of course important to efficiently generate a cryogenic level of coldness, and it is also important to prevent heat from entering the system from outside. In view of this, a heat shield technique has been used in the prior art, in which part or whole of a cryogenic section of the system is covered by a low-temperature plate or cylinder member in order to prevent heat from entering the cryogenic section.

For example, Japanese Laid-Open Patent Publication No. 9-229503 discloses a cryogenic refrigeration system using a heat shield technique. The cryogenic refrigeration system includes a JT refrigerator for generating a liquid helium of a 4 K level, a helium tank for storing the generated liquid helium, a heat shield plate covering the helium tank, and a shield refrigerator for cooling the heat shield plate. Note that in the cryogenic refrigeration system, a superconducting magnet is immersed in the liquid helium in the helium tank and is cooled to a temperature that is less than or equal to the critical temperature.

The cryogenic refrigeration system employs, as the shield refrigerator, a GM refrigerator that uses a helium refrigerant, so that the JT refrigerator and the shield refrigerator can share a compressor. Specifically, the cryogenic refrigeration system includes a low pressure side compressor and a high pressure side compressor, and the JT refrigerator is supplied with a helium gas, which has undergone a two-stage compression through these compressors, whereas the shield refrigerator is supplied with a helium gas, which has been compressed only through the high pressure side compressor.

The refrigeration load of the JT refrigerator and the refrigeration load of the shield refrigerator significantly vary depending on the operating environment under which the system is used. Specifically, heat is prevented by the shield refrigerator from entering the JT refrigerator from outside, whereby the JT refrigerator is less influenced by the atmospheric temperature. However, depending on the type of operation, the refrigeration load thereof is increased by frictional heat due to mechanical vibrations and by a Joule loss due to a magnetic field. Thus, the refrigeration load may fluctuate significantly by, for example, switching between different operations. In the shield refrigerator, in contrast, the majority of the refrigeration load is due to heat entering from outside, whereby the shield refrigerator is more influenced by the atmospheric temperature while the refrigeration load thereof does not significantly fluctuate due to internal frictional heat, etc.

Typically, the capacity of a refrigerator is determined according to the maximum refrigeration load expected. Therefore, the capacity of a JT refrigerator is determined according to the maximum refrigeration load in view of the internal frictional heat, etc. However, the refrigeration load may fluctuate significantly depending on the operating conditions, as described above. Therefore, if the capacity of the JT refrigerator is fixed irrespective of the operating conditions, the refrigeration capacity may be excessive under operating conditions where the internal frictional heat, or the like, does not occur. As a result, the JT refrigerator generates an amount of liquid helium that is more than required, thereby lowering the efficiency of the system.

The problem may be addressed by a capacity control in view of the fluctuation of the refrigeration load of the JT refrigerator in order to improve the efficiency of the system, i.e., a capacity control in which the capacities of the low pressure side compressor and the high pressure side compressor are reduced when the refrigeration load due to frictional heat, etc., is small. With such a control, however, not only the refrigeration capacity of the JT refrigerator, but also the refrigeration capacity of the shield refrigerator, is reduced. Then, the refrigeration capacity of the shield refrigerator may be insufficient because the refrigeration load of the shield refrigerator is substantially constant irrespective of the operating conditions. Therefore, a new technique that can solve the problem has been longed for in the art.

The present invention has been made in view of the above, and has an object to provide a cryogenic refrigeration system capable of operating efficiently while accommodating the fluctuation of the refrigeration load.

SUMMARY OF THE INVENTION

According to the present invention, when the refrigeration load of the helium refrigerator is small, the operation of the pre-cooling circuit of the helium refrigerator is stopped while the operation of the nitrogen refrigerator is continued, thus achieving the object set forth above.

A first cryogenic refrigeration system of the present invention is a cryogenic refrigeration system for cooling a superconducting magnet, including: a helium refrigerator including a first compressor for compressing a helium gas, a second compressor provided on a discharge side of the first compressor, a JT circuit for liquefying, through a Joule. Thomson expansion, the helium gas, which has undergone a two-stage compression through the first compressor and the second compressor, and a pre-cooling circuit for pre-cooling the helium gas of the JT circuit by expanding the helium gas, which has undergone the two-stage compression; a helium tank for storing the liquid helium liquefied by the helium refrigerator and for supplying the liquid helium to the superconducting magnet; a heat shield member for preventing heat from entering the superconducting magnet by using a liquid nitrogen; a nitrogen tank for storing the liquid nitrogen and for supplying the liquid nitrogen to the heat shield member; and a nitrogen refrigerator for generating coldness by expanding the helium gas discharged from the second compressor and for cooling the nitrogen in the nitrogen tank by using the coldness. The first cryogenic refrigeration system further includes a controller for selectively performing one of a normal operation, in which the first compressor and the second compressor are operated and both of the helium refrigerator and the nitrogen refrigerator are operated, and a small-capacity operation, in which the first compressor and the second compressor are operated and an operation of the pre-cooling circuit of the helium refrigerator is stopped while the nitrogen refrigerator is operated.

A second cryogenic refrigeration system is similar to the first cryogenic refrigeration system, wherein: the second compressor is a compressor whose capacity can be controlled; and the controller controls the capacity of the second compressor so that a refrigeration capacity of the nitrogen refrigerator during the small-capacity operation is substantially the same as that during the normal operation.

A third cryogenic refrigeration system is similar to the first cryogenic refrigeration system, wherein the controller switches from the normal operation to the small-capacity operation when an amount of liquid helium in the helium tank increases above a predetermined amount during the normal operation.

A fourth cryogenic refrigeration system is similar to the first cryogenic refrigeration system, wherein the controller switches from the small-capacity operation to the normal operation when an amount of liquid helium in the helium tank decreases below a predetermined amount during the small-capacity operation.

A fifth cryogenic refrigeration system is similar to the first cryogenic refrigeration system, further including a liquid level sensor provided in the helium tank, wherein the controller switches from the normal operation to the small-capacity operation when a liquid level of the liquid helium in the helium tank rises above a predetermined position during the normal operation, whereas the controller switches from the small, capacity operation to the normal operation when the liquid level of the liquid helium in the helium tank lowers below a predetermined position during the small-capacity operation.

Note that the predetermined position based on which the operation is switched from the normal operation to the small-capacity operation may be the same as, or different from, the predetermined position based on which the operation is switched from the small-capacity operation to the normal operation.

A sixth cryogenic refrigeration system is similar to the first cryogenic refrigeration system, further including: a buffer tank connected to the JT circuit for collecting the helium gas from the JT circuit when a helium gas pressure on a high pressure side of the JT circuit increases above a predetermined upper limit value, while supplying the helium gas to the JT circuit when a helium gas pressure on a low pressure side of the JT circuit decreases below a predetermined lower limit value; and a pressure sensor for detecting a pressure of the helium gas in the buffer tank, wherein the controller switches from the normal operation to the small-capacity operation when the pressure of the helium gas in the buffer tank decreases below a predetermined pressure during the normal operation, whereas the controller switches from the small-capacity operation to the normal operation when the pressure of the helium gas in the buffer tank increases above a predetermined pressure during the small-capacity operation.

Note that the predetermined pressure based on which the operation is switched from the normal operation to the small-capacity operation may be the same as, or different from, the predetermined pressure based on which the operation is switched from the small-capacity operation to the normal operation.

With the first cryogenic refrigeration system, when the refrigeration load of the helium refrigerator is large, a refrigeration operation is performed in both of the helium refrigerator and the nitrogen refrigerator ("normal operation"). On the other hand, when the refrigeration load of only the helium refrigerator decreases, the operation of the pre-cooling circuit of the helium refrigerator is stopped while the refrigeration operation of the nitrogen refrigerator is continued ("small-capacity operation"). Therefore, it is possible to suppress the refrigeration capacity of the whole system without lowering the power of the nitrogen refrigerator, thereby improving the operation efficiency and reducing the power consumption.

With the second cryogenic refrigeration system, the second compressor is a compressor whose capacity can be controlled, and the capacity of the second compressor is controlled so that the refrigeration capacity of the nitrogen refrigerator during the normal operation is substantially the same as that during the small-capacity operation, whereby helium is not excessively supplied to the nitrogen refrigerator during the small-capacity operation, thus preventing the power of the nitrogen refrigerator from being excessive. In this way, it is possible to suppress the fluctuation of the power of the nitrogen refrigerator due to the operation switching, thus preventing the operation efficiency of the nitrogen refrigerator from lowering.

With the third cryogenic refrigeration system, when the amount of liquid helium in the helium tank increases above a predetermined amount during the normal operation, it is assumed that the power of the helium refrigerator is excessive, and thus the operation is switched from the normal operation to the small-capacity operation. As a result, it is possible to prevent the system from operating with an excessive power, thereby improving the operation efficiency and reducing the power consumption.

With the fourth cryogenic refrigeration system, when the amount of liquid helium in the helium tank decreases below a predetermined amount during the small-capacity operation, it is assumed that more liquid helium is required for cooling the superconducting magnet, and thus the operation is switched from the small-capacity operation to the normal operation. As a result, the pre-cooling circuit of the helium refrigerator resumes its operation, whereby the amount of liquid helium in the helium tank increases. Thus, the superconducting magnet is stably cooled to a predetermined temperature level.

With the fifth cryogenic refrigeration system, the position of the liquid level of the liquid helium in the helium tank is detected by the liquid level sensor, and the amount of liquid helium is estimated based on the position of the liquid level. When the liquid level rises above a predetermined position during the normal operation, it is assumed that the refrigeration capacity of the helium refrigerator is excessive, and thus the operation is switched from the normal operation to the small-capacity operation. When the liquid level lowers below a predetermined position during the small-capacity operation, it is assumed that the amount of liquid helium is insufficient, and thus the operation is switched from the small-capacity operation to the normal operation.

With the sixth cryogenic refrigeration system, the amount of liquid helium in the helium tank is estimated based on the internal pressure of the buffer tank provided in the helium JT circuit. When the internal pressure of the buffer tank decreases below a predetermined pressure during the normal operation, it is assumed that a sufficient amount of helium, having been stored in the buffer tank, has moved to the helium tank and is now stored in the helium tank in the form of liquid helium, and thus the operation is switched from the normal operation to the small-capacity operation. When the internal pressure of the buffer tank increases above a predetermined pressure during the small-capacity operation, it is assumed that a significant amount of helium, having been stored in the helium tank, has evaporated and is now stored in the buffer tank, and thus the operation is switched from the small-capacity operation to the normal operation.

According to the present invention, a refrigeration operation is performed in both of the helium refrigerator and the nitrogen refrigerator when the refrigeration load is large, whereas the operation of the pre-cooling circuit of the helium refrigerator is stopped while the operation of the nitrogen refrigerator is continued when the refrigeration load of the helium refrigerator decreases. Therefore, it is possible to improve the operation efficiency and to reduce the power consumption while ensuring a required level of refrigeration capacity.

By controlling the capacity of the second compressor so that the refrigeration capacity of the nitrogen refrigerator during the small-capacity operation is substantially the same as that during the normal operation, it is possible to suppress the fluctuation of the power of the nitrogen refrigerator due to the operation switching, thus improving the operation efficiency.

DESCRIPTION OF THE PREFERRED EMBODIMENTS

Embodiments of the present invention will now be described with reference to the drawings.

EMBODIMENT 1

Figure 1:
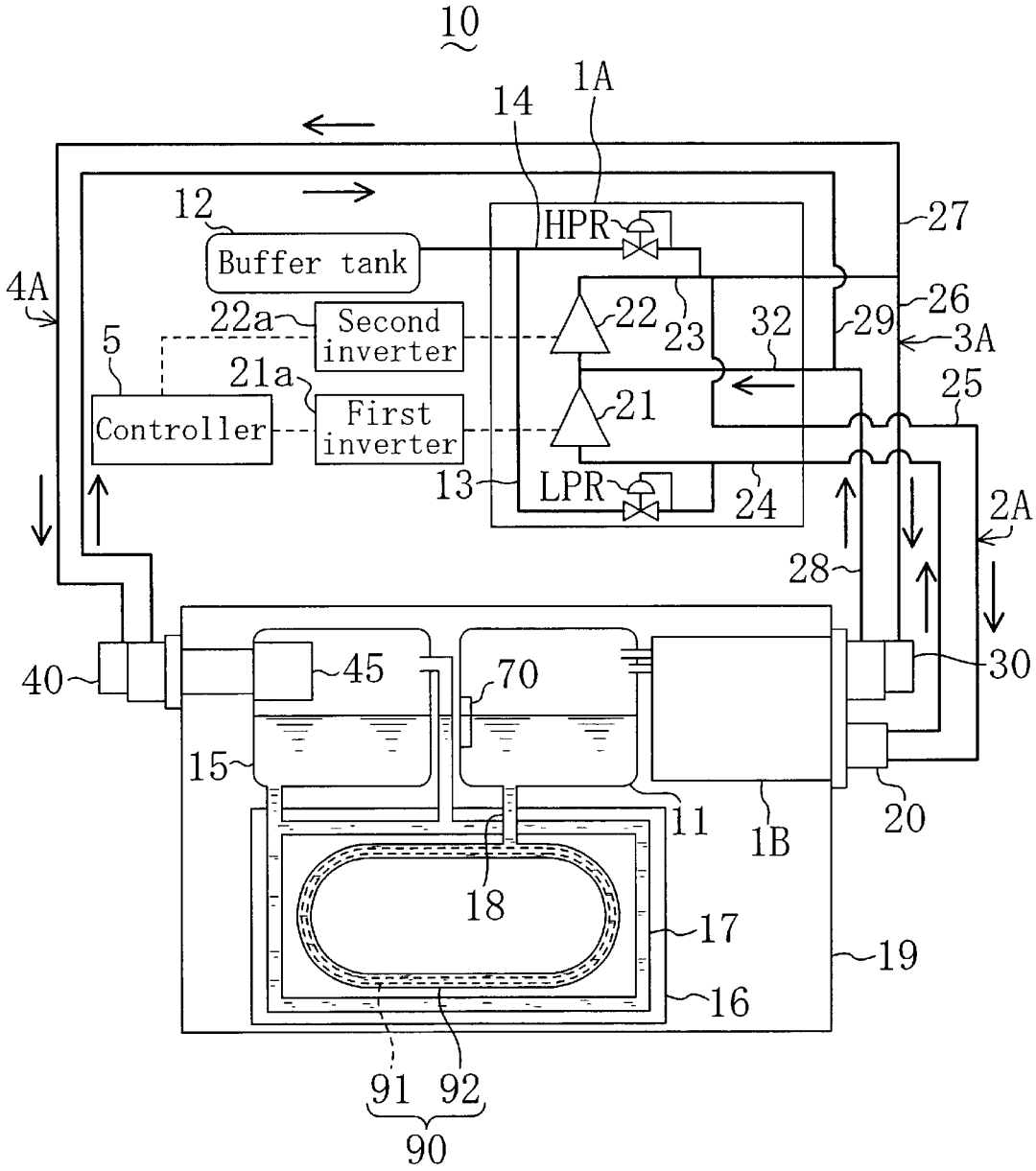
FIG. 1 is a diagram illustrating a configuration of a cryogenic refrigeration system according to Embodiment 1.

FIG. 1 illustrates a cryogenic refrigeration system (10), which is an on-vehicle refrigeration system that is installed in a superconducting linear motor car (not shown) for cooling a superconducting magnet (90) of the superconducting linear motor car.

CONFIGURATION OF CRYOGENIC REFRIGERATION SYSTEM

The cryogenic refrigeration system (10) includes a helium refrigerator (20) for generating, cooling and maintaining a liquid helium, and a nitrogen refrigerator (40) for cooling and maintaining a liquid nitrogen. The helium refrigerator (20) includes a pre-cooling refrigerator (30) for pre-cooling helium. The helium refrigerator (20) and the nitrogen refrigerator (40) both use helium as a refrigerant.

The cryogenic refrigeration system (10) includes the helium refrigerator (20) and a second circuit (4A), which is a refrigerant circuit of the nitrogen refrigerator (40). The helium refrigerator (20) includes a first circuit (2A), which is a JT circuit, and a pre-cooling circuit (3A), which is a refrigerant circuit of the pre-cooling refrigerator (30). Helium, as a refrigerant, circulates in the circuits (2A, 3A, 4A). Thus, each of the circuits (2A, 3A, 4A) is a circulatory circuit for helium.

The cryogenic refrigeration system (10) further includes a compressor unit (1A), and an external vessel (19) for housing the superconducting magnet (90), etc. The compressor unit (1A) functions as a common compressor unit for the first circuit (2A), the pre-cooling circuit (3A) and the second circuit (4A). The compressor unit (1A) includes a low pressure side compressor (21) and a high pressure side compressor (22). The compressors (21, 22) are so-called "inverter compressors",and include inverters (21*a*, 22*a*), respectively. A controller (5), capable of controlling the inverters (21*a*, 22*a*), is connected to the inverters (21*a*, 22*a*).

A low pressure pipe (24) is connected to the suction side of the low pressure side compressor (21). An medium pressure pipe (32) is connected between the discharge side of the low pressure side compressor (21) and the suction side of the high pressure side compressor (22). A high pressure pipe (23) is connected to the discharge side of the high pressure side compressor (22). The high pressure pipe (23) diverges into a high pressure pipe (25) of the first circuit (2A), a high pressure pipe (26) of the pre-cooling circuit (3A), and a high pressure pipe (27) of the second circuit (4A). The medium pressure pipe (32) diverges into a medium pressure pipe (28) of the pre-cooling circuit (3A), and a medium pressure pipe (29) of the second circuit (4A). The low pressure pipe (24) is connected to the low pressure side of the first circuit (2A).

A buffer tank (12) is connected to the low pressure pipe (24) via a gas supply pipe (13). A low pressure control valve (LPR) is provided along the gas supply pipe (13). The low pressure control valve (LPR) is designed so that it is automatically opened when the pressure of the low pressure pipe (24) (i.e., the pressure on the low pressure side of the compressor unit (1A)) decreases below a predetermined value. As the pressure on the low pressure side of the compressor unit (1A) decreases and the low pressure control valve (LPR) is opened, the helium gas in the buffer tank (12) is re-supplied to the low pressure side compressor (21).

A gas collecting pipe (14) diverging from the high pressure pipe (23) is connected to the gas supply pipe (13). A high pressure control valve (HPR) is provided along the gas collecting pipe (14). The high pressure control valve (HPR) is designed so that it is automatically opened when the pressure of the high pressure pipe (23) (i.e., the pressure on the high pressure side of the compressor unit (1A)) increases above a predetermined value. As the pressure on the high pressure side of the compressor unit (1A) increases and the high pressure control valve (HPR) is opened, the helium gas is collected into the buffer tank (12).

The external vessel (19) includes a refrigerator unit (1B), in which the helium refrigerator (20) is housed, a helium tank (11), the nitrogen refrigerator (40), a nitrogen tank (15), the superconducting magnet (90), and a shield plate (16) for thermally shielding the superconducting magnet (90). The external vessel (19) is a so-called "vacuum insulation vessel", and the inside thereof is thermally insulated by a vacuum.

The configuration of the refrigerator unit (1B) will now be described with reference to FIG. 2. The pre-cooling refrigerator (30) is provided for the purpose of pre-cooling a high pressure helium gas of the first circuit (2A), and is a gas pressure driven GM (Gifford-McMahon) cycle refrigerator, in which a displacer is reciprocated by the pressure of a helium gas. The pre-cooling refrigerator (30) includes a motor head (34) and a two-stage cylinder (35) coupled to the motor head (34). The high pressure pipe (26) and the medium pressure pipe (28) are connected to the motor head (34). A first heat station (36), which is cooled and maintained at a predetermined temperature level, is provided on the distal side of the large-diameter portion of the cylinder (35). Moreover, a second heat station (37), which is cooled and maintained at a temperature level that is lower than the first heat station (36), is provided on the distal side of the small-diameter portion of the cylinder (35).

The first circuit (2A) of the helium refrigerator (20) is a circuit that generates coldness of about 4 K level through a Joule-Thomson expansion of a helium gas. The helium refrigerator (20) includes a first heat exchanger (43), a second heat exchanger (50), a third heat exchanger (60) and a JT valve (44). Each of the heat exchangers (43, 50, 60) exchanges heat between a high pressure helium gas and a low pressure helium gas from the helium tank (11). The first heat exchanger (43), the second heat exchanger (50) and the third heat exchanger (60) have successively decreasing heat exchange temperatures.

The inlet side of a high pressure side passageway (41) of the first heat exchanger (43) is connected to the high pressure pipe (25). A first pre-cooling section (31) is provided between the outlet side of the high pressure side passageway (41) of the first heat exchanger (43) and the inlet side of a high pressure side passageway (51) of the second heat exchanger (50). The first pre-cooling section (31) is provided around the periphery of the first heat station (36) of the pre-cooling refrigerator (30). A second pre-cooling section (33) is provided between the outlet side of the high pressure side passageway (51) of the second heat exchanger (50) and the inlet side of a high pressure side passageway (61) of the third heat exchanger (60). The second pre-cooling section (33) is provided around the periphery of the second heat station (37) of the pre-cooling refrigerator (30). The JT valve (44) is provided between the outlet side of the high pressure side passageway (61) of the third heat exchanger (60) and the helium tank (11). An operation rod (2d) for adjusting the valve opening is coupled to the JT valve (44).

A low pressure side passageway (62) of the third heat exchanger (60) is connected to the helium tank (11) via a refrigerant pipe. The low pressure side passageway (62) of the third heat exchanger (60), a low pressure side passageway (52) of the second heat exchanger (50) and a low pressure side passageway (42) of the first heat exchanger (43) are connected in series by a refrigerant pipe. The low pressure side passageway (42) of the first heat exchanger (43) is connected to the low pressure pipe (24).

As illustrated in FIG. 1, the nitrogen refrigerator (40) is connected to the high pressure pipe (27) and the medium pressure pipe (29). The nitrogen refrigerator (40) is a G-M cycle refrigerator, as is the pre-cooling refrigerator (30). Note however that the pre-cooling refrigerator (30) and the nitrogen refrigerator (40) are not limited to a G-M cycle refrigerator, but may alternatively be any other suitable refrigerator such as a Stirling refrigerator or a pulse-tube refrigerator. A heat station (45) of the nitrogen refrigerator (40) is provided inside the nitrogen tank (15). The heat station (45) is designed to cool and maintain coldness of about 80 K level.

The helium tank (11) and the superconducting magnet (90) are connected to each other via a communication pipe (18). The superconducting magnet (90) includes a superconducting coil (91) and a container (92) for housing the superconducting coil (91) therein. The inside of the container (92) is always filled with a liquid helium, and the superconducting coil (91) is cooled by being immersed in the liquid helium. The helium tank (11) includes a liquid level sensor (70). The liquid level sensor (70) is connected to the controller (5) via a signal line (not shown) so that information regarding the liquid level of the liquid helium in the helium tank (11) is automatically transmitted to the controller (5).

The shield plate (16) for preventing heat from entering the superconducting magnet (90) is provided around the superconducting magnet (90). A cooling pipe (17) is attached to the shield plate (16). The cooling pipe (17) is connected to the nitrogen tank (15) so that the inside of the cooling pipe (17) is always filled with a liquid nitrogen. Thus, the shield plate (16) is maintained at a low temperature of about 80 K level by the liquid nitrogen in the cooling pipe (17).

OPERATIONS OF CRYOGENIC REFRIGERATION SYSTEM

Next, the operations of the cryogenic refrigeration system (10) will be described. The cryogenic refrigeration system (10) selectively performs a normal operation and a small-capacity operation as follows.

First, the normal operation will be described. The normal operation is an operation that is performed when the refrigeration load of the helium refrigerator (20) is large, and is an operation that is performed primarily while the superconducting linear motor car is running. Note that as long as there is a heat shield provided by the shield plate (16), the internal heat generation entailed by the running of the superconducting linear motor car accounts for a large proportion as to the proportion of the refrigeration load of the helium refrigerator (20).

During the normal operation, a liquid helium is always being generated by the helium refrigerator (20). The superconducting coil (91) of the superconducting magnet (90) is cooled and maintained by the liquid helium to a temperature that is less than or equal to the critical temperature. A portion of the liquid helium in the superconducting magnet (90) or the helium tank (11) evaporates due to heat that is generated by the running of the superconducting linear motor car or heat that is entering from outside. The helium gas thus generated through evaporation is collected from the helium tank (11) into the helium refrigerator (20), compressed through the compressor unit (1A) and then re-liquefied through the helium refrigerator (20). The liquefied helium is supplied to the helium tank (11). Through such a helium circulation, a predetermined amount of liquid helium is always stored in the helium tank (11), and thus the superconducting coil (91) is cooled stably. On the other hand, a nitrogen gas that is generated through evaporation in the cooling pipe (17) or the nitrogen tank (15) is cooled, and re-liquefied, by the heat station (45) of the nitrogen refrigerator (40).

Next, the helium circulation during the normal operation will be described. As shown by a solid-line arrow in FIG. 1, the high pressure helium gas discharged from the high pressure side compressor (22) first diverges into flows through the high pressure pipe (25) of the first circuit (2A), the high pressure pipe (26) of the pre-cooling refrigerator (30) and the high pressure pipe (27) of the second circuit (4A).

Figure 2:
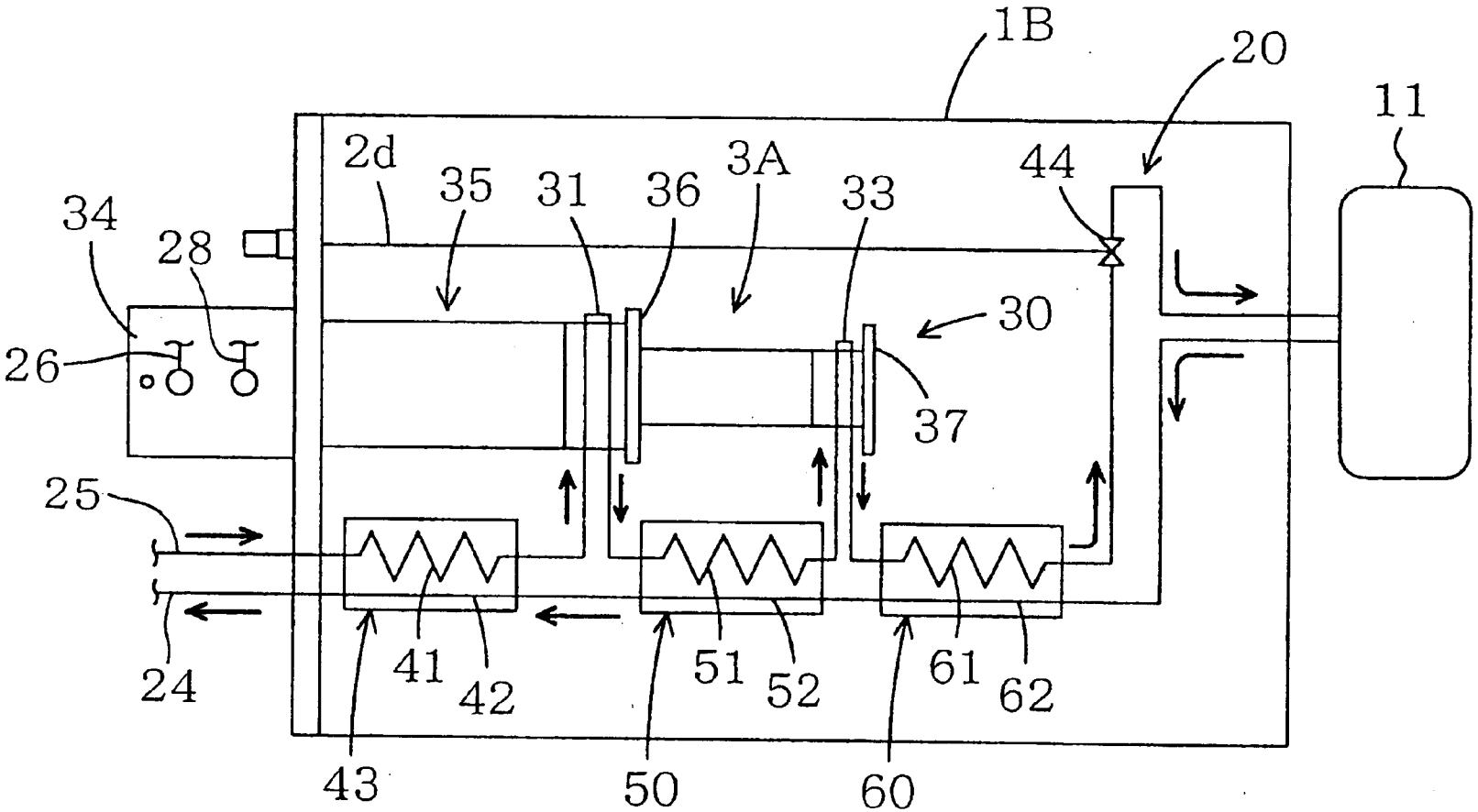
FIG. 2 is a diagram illustrating a configuration of a refrigerator unit.

The high pressure helium gas, which has flowed into the high pressure pipe (26) of the pre-cooling circuit (3A), is expanded in expansion spaces in the cylinder (35) of the pre-cooling refrigerator (30) (see FIG. 2). The temperature of the helium gas decreases through the helium gas expansion, whereby each of the heat stations (36, 37) is cooled to a predetermined temperature level. The expanded helium gas returns to the compressor unit (1A) via the medium pressure pipe (28), and is sucked into the high pressure side compressor (22) via the medium pressure pipe (32).

The high pressure helium gas, which has flowed into the high pressure pipe (25) of the first circuit (2A), passes through the first circuit (2A) as shown by a solid-line arrow in FIG. 2. Specifically, the high pressure helium gas in the high pressure pipe (25) first passes through the high pressure side passageway (41) of the first heat exchanger (43). At this time, the high pressure helium gas passing through the high pressure side passageway (41) is cooled while it exchanges heat with the low pressure helium gas passing through the low pressure side passageway (42). For example, the high pressure helium gas is cooled in the first heat exchanger (43) from 300 K, which is a room temperature, to about 50 K. Then, the high pressure helium gas flows through the first pre-cooling section (31), and is cooled by the first heat station (36) of the pre-cooling refrigerator (30).

Then, the high pressure helium gas passes through the high pressure side passageway (51) of the second heat exchanger (50), and is cooled while it exchanges heat with the low pressure helium gas passing through the low pressure side passageway (52). For example, the high pressure helium gas is cooled to about 15 K while it passes through the high pressure side passageway (51) of the second heat exchanger (50). Then, the high pressure helium gas passes through the second pre-cooling section (33), and is cooled by the second heat station (37) of the pre-cooling refrigerator (30).

Then, the high pressure helium gas passes through the high pressure side passageway (61) of the third heat exchanger (60). At this time, the high pressure helium gas is cooled while it exchanges heat with the low pressure helium gas passing through the low pressure side passageway (62).

Then, the high pressure helium gas is turned into liquid helium at about 4 K by a Joule-Thomson expansion through the JT valve (44). Then, the liquid helium flows into the helium tank (11).

On the other hand, a low pressure helium gas in the helium tank (11) flows from the low pressure side passageway (62) of the third heat exchanger (60) to the low pressure side passageway (52) of the second heat exchanger (50), and then to the low pressure side passageway (42) of the first heat exchanger (43), and is sucked into the low pressure side compressor (21) of the compressor unit (1A) via the low pressure pipe (24).

The high pressure helium gas, which has flowed into the high pressure pipe (27) of the second circuit (4A), is expanded in an expansion space in a cylinder (not shown) of the nitrogen refrigerator (40). Through the expansion of the helium gas, the heat station (45) is cooled and maintained at about 80 K. The expanded helium gas returns to the compressor unit (1A) via the medium pressure pipe (29), and is sucked into the high pressure side compressor (22) via the medium pressure pipe (32).

As the internal pressure of the helium tank (11) increases, such a pressure increase in turn increases the pressure on the high pressure side of the first circuit (2A). Then, the high pressure control valve (HPR) is opened, and a portion of the helium gas in the first circuit (2A) is collected into the buffer tank (12) via the collecting pipe (14). As a result, the pressure on the high pressure side of the first circuit (2A) decreases back to a predetermined pressure. Then, the internal pressure of the helium tank (11) decreases back to a predetermined pressure, following the pressure on the high pressure side of the first circuit (2A).

On the other hand, as the internal pressure of the helium tank (11) decreases, such a pressure decrease in turn decreases the pressure on the low pressure side of the first circuit (2A). Then, the low pressure control valve (LPR) is opened, and a helium gas is supplied from the buffer tank (12) to the first circuit (2A). As a result, the pressure on the low pressure side of the first circuit (2A) increases back to a predetermined pressure. Then, the internal pressure of the helium tank (11) increases back to a predetermined pressure, following the pressure on the low pressure side of the first circuit (2A). In this way, the internal pressure of the helium tank (11) is maintained at a constant level.

On the other hand, the internal pressure of the nitrogen tank (15) is maintained at a constant level by a power control for controlling the power of the nitrogen refrigerator (40). The power of the nitrogen refrigerator (40) is adjusted by a capacity control for controlling the capacity of the high pressure side compressor (22).

When the refrigeration load of the helium refrigerator (20) is small, e.g., when the superconducting linear motor car is not running, the amount of liquid helium that evaporates in the superconducting magnet (90) and the helium tank (11) decreases, whereby the amount of liquid helium generated by the helium refrigerator (20) increases to be excessive. Therefore, the amount of liquid helium in the helium tank (11) increases, and the liquid level thereof rises. In the present embodiment, when the liquid level of the liquid helium in the helium tank (11) rises above a predetermined position, the normal operation is switched by the controller (5) to a small-capacity operation as follows.

The small-capacity operation is an operation that is performed when the refrigeration load of the helium refrigerator (20) is small, and is an operation that is performed primarily while the superconducting linear motor car is not running. Note that although the refrigeration load of the helium refrigerator (20) is small while the superconducting linear motor car is not running because there is no heat generated by the running of the superconducting linear motor car, the refrigeration load of the nitrogen refrigerator (40) does not change even when the superconducting linear motor car stops running because of the majority of the refrigeration load of the nitrogen refrigerator (40) is the heat entering from outside through radiation.

During the small-capacity operation, the operation of the pre-cooling circuit (3A) of the pre-cooling refrigerator (30) in the helium refrigerator (20) is stopped, and the generation of the liquid helium is stopped. On the other hand, the low pressure side compressor (21) and the high pressure side compressor (22) continue to operate, and the operation of the nitrogen refrigerator (40) is continued.

Figure 3:
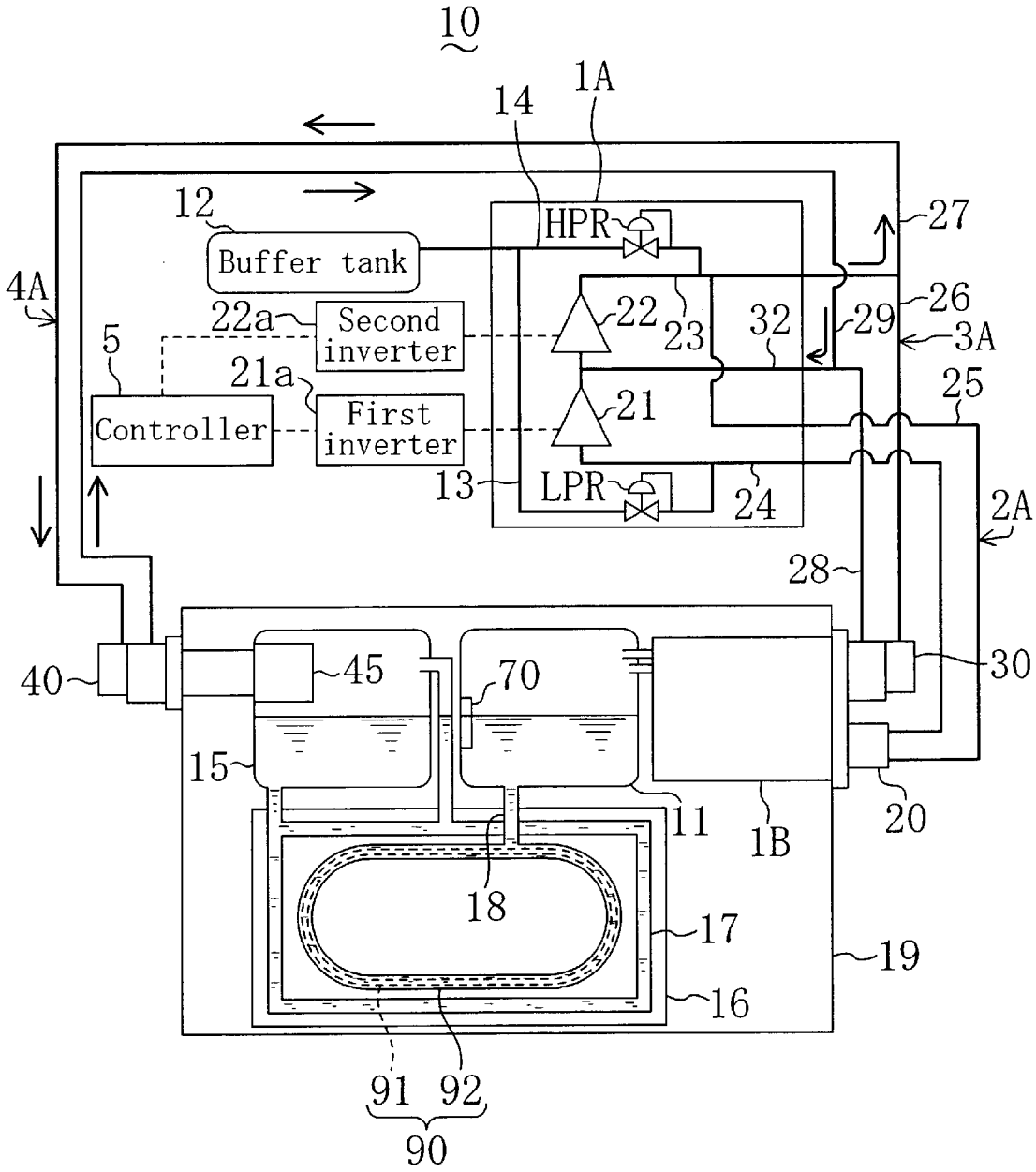
FIG. 3 is a diagram illustrating a configuration of a cryogenic refrigeration system, showing a refrigerant circulation during a small-capacity operation.

During the small-capacity operation, the helium gas discharged from the high pressure side compressor (22) flows through the high pressure pipe (27) of the second circuit (4A) into the nitrogen refrigerator (40), as shown by a solid-line arrow in FIG. 3. The helium gas is expanded in the expansion space in the cylinder (not shown) of the nitrogen refrigerator (40), whereby the heat station (45) is cooled and maintained at about 80 K. The expanded helium gas returns to the compressor unit (1A) via the medium pressure pipe (29), and is sucked into the high pressure side compressor (22) via the medium pressure pipe (32).

During the small-capacity operation, it is preferred that the capacity of the high pressure side compressor (22) is controlled by the second inverter **(22*a*) so that the amount of helium being circulated in the nitrogen refrigerator (40) is maintained at a constant level. In the present embodiment, the controller (5) decreases the operating frequency of the high pressure side compressor (22) when the operation is switched from the normal operation to the small-capacity operation. Through such a control, the refrigeration capacity of the nitrogen refrigerator (40)** is maintained at a level that is substantially the same as that during the normal operation.

As the small-capacity operation is continued, the amount of liquid helium in the helium tank (11) decreases, and the amount of liquid helium will be insufficient over time.

Moreover, the amount of liquid helium is insufficient also at other times, e.g., when the superconducting linear motor car restarts. In view of this, the controller (5) switches the operation from the small-capacity operation to the normal operation when the liquid level of the liquid helium in the helium tank (11) lowers below a predetermined position. As a result, the pre-cooling refrigerator (30) resumes its operation, and the operating frequency of the high pressure side compressor (22) increases. Then, the pre-cooling refrigerator (30) of the helium refrigerator (20) resumes its operation, and the generation of the liquid helium is resumed.

EFFECTS

Thus, according to the present embodiment, when the refrigeration load of the helium refrigerator (20) is small, the small-capacity operation is performed, in which the operation of the pre-cooling refrigerator (30) of the helium refrigerator (20) is stopped while the operation of the nitrogen refrigerator (40) is continued. Therefore, it is possible to prevent an excessive refrigeration operation of the helium refrigerator (20) while preventing heat from entering from outside. Therefore, it is possible to improve the operation efficiency and to reduce the power consumption.

Moreover, the operating frequency of the high pressure side compressor (22) is reduced during the small-capacity operation, whereby the amount of helium being circulated in the nitrogen refrigerator (40) can be maintained at a level that is substantially the same as that during the normal operation. Thus, it is possible to prevent the refrigeration capacity of the nitrogen refrigerator (40) from fluctuating due to the operation switching, and thus to improve the operation efficiency.

EMBODIMENT 2

Figure 4:
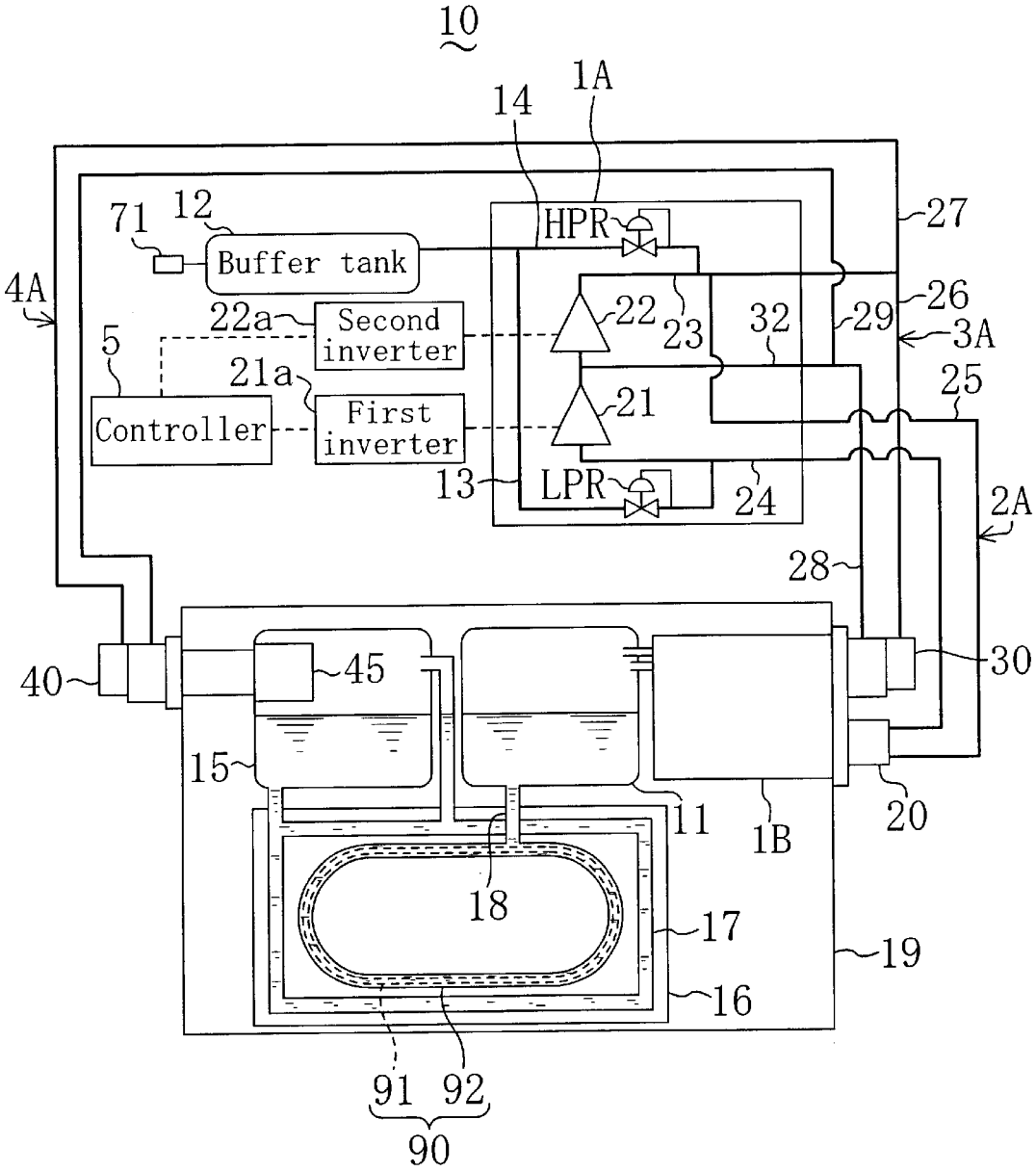
FIG. 4 is a diagram illustrating a configuration of a cryogenic refrigeration system according to Embodiment 2.

As the means for detecting the amount of liquid helium in the helium tank (11), a pressure sensor (71) for detecting the internal pressure of the buffer tank (12) may be provided, instead of the liquid level sensor (70), as illustrated in FIG. 4.

As described above, the cryogenic refrigeration system (10) includes the buffer tank (12) for supplying and collecting the helium gas in order to maintain the pressure of each of the circuits (2A, 3A, 4A), in which helium circulates, at a predetermined pressure. Therefore, a certain correlation is observed between the amount of liquid helium in the helium tank (11) and the internal pressure of the buffer tank (12). Specifically, as more liquid helium evaporates in the helium tank (11), the internal pressure of the buffer tank (12) increases while the amount of liquid helium decreases. In contrast, as less liquid helium evaporates in the helium tank (11), the internal pressure of the buffer tank (12) decreases while the amount of liquid helium increases.

In the present embodiment, the correlation as described above is utilized. Specifically, the refrigeration load of the helium refrigerator (20) is estimated based on the internal pressure of the buffer tank (12), and the operation is switched based on the estimation. Specifically, the operation is switched from the normal operation to the small-capacity operation when the internal pressure of the buffer tank (12) decreases below a predetermined value. On the other hand, the operation is switched from the small-capacity operation to the normal operation when the internal pressure of the buffer tank (12) increases above a predetermined value.

Thus, effects as those of Embodiment 1 can be obtained also in Embodiment 2. Furthermore, in Embodiment 2, the pressure sensor (71) is provided in the buffer tank (12), which is a room temperature section, whereby the reliability can be further improved as compared with a case where a sensor is provided in the helium tank (11), which is a cryogenic section.

The present invention is not limited to the first and second embodiments set forth above, but may be carried out in various other ways without departing from the sprit or main features thereof Thus, the embodiments set forth above are merely illustrative in every respect, and should not be taken as limiting. The scope of the present invention is defined by the appended claims, and in no way is limited to the description set forth herein. Moreover, any variations and/or modifications that are equivalent in scope to the claims fall within the scope of the present invention.

What is claimed is:

1. A cryogenic refrigeration system for cooling a superconducting magnet, comprising:

a helium refrigerator including a first compressor for compressing a helium gas, a second compressor provided on a discharge side of the first compressor, a JT circuit for liquefying, through a Joule-Thomson expansion, the helium gas, which has undergone a two-stage compression through the first compressor and the second compressor, and a pre-cooling circuit for pre-cooling the helium gas of the JT circuit by expanding the helium gas, which has undergone the two-stage compression;

a helium tank for storing the liquid helium liquefied by the helium refrigerator and for supplying the liquid helium to the superconducting magnet;

a heat shield member for preventing heat from entering the superconducting magnet by using a liquid nitrogen;

a nitrogen tank for storing the liquid nitrogen and for supplying the liquid nitrogen to the heat shield member;

a nitrogen refrigerator for generating coldness by expanding the helium gas discharged from the second compressor and for cooling the nitrogen in the nitrogen tank by using the coldness; and a controller for selectively performing one of a normal operation, in which the first compressor and the second compressor are operated and both of the helium refrigerator and the nitrogen refrigerator are operated, and a small-capacity operation, in which the first compressor and the second compressor are operated and an operation of the pre-cooling circuit of the helium refrigerator is stopped while the nitrogen refrigerator is operated.

2. The cryogenic refrigeration system of claim 1, wherein:

the second compressor is a compressor whose capacity can be controlled; and the controller controls the capacity of the second compressor so that a refrigeration capacity of the nitrogen refrigerator during the small-capacity operation is substantially the same as that during the normal operation.

3. The cryogenic refrigeration system of claim 1, wherein the controller switches from the normal operation to the small-capacity operation when an amount of liquid helium in the helium tank increases above a predetermined amount during the normal operation.

4. The cryogenic refrigeration system of claim 1, wherein the controller switches from the small-capacity operation to the normal operation when an amount of liquid helium in the helium tank decreases below a predetermined amount during the small-capacity operation.

5. The cryogenic refrigeration system of claim 1, further comprising a liquid level sensor provided in the helium tank, wherein the controller switches from the normal operation to the small-capacity operation when a liquid level of the liquid helium in the helium tank rises above a predetermined position during the normal operation, whereas the controller switches from the small-capacity operation to the normal operation when the liquid level of the liquid helium in the helium tank lowers below a predetermined position during the small-capacity operation.

6. The cryogenic refrigeration system of claim 1, further comprising:

a buffer tank connected to the JT circuit for collecting the helium gas from the JT circuit when a helium gas pressure on a high pressure side of the JT circuit increases above a predetermined upper limit value, while supplying the helium gas to the JT circuit when a helium gas pressure on a low pressure side of the JT circuit decreases below a predetermined lower limit value; and a pressure sensor for detecting a pressure of the helium gas in the buffer tank, wherein the controller switches from the normal operation to the small-capacity operation when the pressure of the helium gas in the buffer tank decreases below a predetermined pressure during the normal operation, whereas the controller switches from the small-capacity operation to the normal operation when the pressure of the helium gas in the buffer tank increases above a predetermined pressure during the small-capacity operation.

* * * * *